United States Patent [19]

Kubbutat

[11] Patent Number: 4,606,160

[45] Date of Patent: Aug. 19, 1986

[54] PLASTER BACKING PANEL FOR VENTILATED CURTAIN WALL SYSTEM

[75] Inventor: Albert Kubbutat, Wittislingen, Fed. Rep. of Germany

[73] Assignee: Stotmeister GmbH, Stuehlingen-Weizen, Fed. Rep. of Germany

[21] Appl. No.: 733,734

[22] Filed: May 14, 1985

[30] Foreign Application Priority Data

May 22, 1984 [DE] Fed. Rep. of Germany ..... 3418964

[51] Int. Cl.[4] ..... E04B 2/88

[52] U.S. Cl. ..... 52/235; 52/303; 52/345; 52/508

[58] Field of Search ..... 52/410, 235, 351, 428, 52/418, 511, 508, 302, 303, 588, 344, 345, 366

[56] References Cited

U.S. PATENT DOCUMENTS

| | | | |
|---|---|---|---|
| 664,707 | 12/1900 | Anderson | 52/351 |
| 1,640,065 | 8/1927 | Blaw | 52/303 |
| 1,952,449 | 3/1934 | Marks | 52/344 |
| 2,073,036 | 3/1937 | Voigt | 52/588 |
| 2,580,231 | 12/1951 | Lamm | 52/366 |
| 2,935,865 | 5/1960 | Munro | 52/303 |
| 3,481,094 | 12/1969 | Taylor | 52/588 |
| 3,722,163 | 3/1973 | Satkin | 52/511 |
| 4,458,462 | 7/1984 | Schold | 52/508 |

FOREIGN PATENT DOCUMENTS

| | | | |
|---|---|---|---|
| 551827 | 1/1958 | Canada | 52/344 |

*Primary Examiner*—John E. Murtagh

*Attorney, Agent, or Firm*—Holman & Stern

[57] ABSTRACT

A plaster backing panel structure for a ventilated curtain wall system comprises rectangular light-weight wood fiber panels for mounting on a framework attached to a vertical building wall with a ventilation space of predetermined width behind the panels, wherein the panels are provided with complimentary angle members adjacent respective longitudinal edges thereof. The angle members include rearwardly extending webs of interengaging hook-shaped form whereby adjacent panels are attached together by male and female connections formed by inserting the angle member web adjacent an edge of one channel into a complimentary angle section web at the edge of an adjacent panel. The panels are also provided with butt plates on their transverse edges and angle members forming corner or foundation closures.

15 Claims, 6 Drawing Figures

PLASTER BACKING PANEL FOR VENTILATED CURTAIN WALL SYSTEM

BACKGROUND OF THE INVENTION

This invention relates to a plaster backing panel for a ventilated curtain wall system, comprising essentially a rectangular light-weight wood-fiber panel which is mounted on a framework attached to a vertical building wall so as to leave an air space of predetermined size for ventilation.

Plaster backing panels of the above type are made of a light-weight wood-fiber panel as per DIN Specification 1101 and are generally available in dimensions of 200 cm×50 cm, and a thickness of 8 mm. They have crosswise indentations which provide a certain rigidity. Lengthwise, however, the plaster backing panels have only low inherent rigidity. Thus, a framework is needed for mounting such panels, which consists of an inner wood lathing adjoining the building wall and an outer wood lathing placed perpendicularly on top of the panel. The wood slats which make up the outer wood lathing are placed relatively close together, i.e. at intervals of 40–50 cm. The plaster backing panels are placed flush against each other and are secured to the outer lathing with screw nails. In order to obtain better anchoring of the subsequent plaster layer, a wire netting with a mesh size 25×25 mm and 1 mm wire thickness is hung on the outside for bridging the joints between individual plaster backing panels, in order to avoid cracks in the plaster, and for increasing the rigidity of the plaster layer, since the plaster backing panel itself has only a relatively limited inherent rigidity. For this reason it is also necessary to apply a three-layer plastering system, starting with a sprayed cement layer which encases the wire netting and which must cure and dry before the first plaster coat can be applied. The final coat is then applied over the first coat. This familiar plaster backing panel is thus relatively labor intensive at the construction site. Specifically, a relatively tight outer lathing must be attached on the inner lathing, and after mounting the plaster backing panels, the close-meshed netting still has to be put on for plaster reinforcement. Applying a three-layer plaster system is also labor intensive.

SUMMARY OF THE INVENTION

Accordingly, the invention has as an object the provision of a plaster backing panel for a ventilated curtain wall system of the aforementioned type, but which requires less time than known panels for mounting same at a construction site, which can eliminate the use of wire netting as plaster reinforcement, and on which it is possible to apply a relatively thin plaster layer, specifically a thin synthetic-resin coating.

According to the invention, the above object is achieved by affixing, during production, an angle section near each of the longitudinal edges of the light-weight panel's inner side, i.e. that facing towards the ventilation space; one web of the angle section which lies against the inner side of the panel having an array of holes filled with adhesive and the other web of the angle section being bent in the shape of a hook. The outer web of the angle section on one longitudinal edge of the panel is directed towards the center of the panel and the web of the second angle section on the other longitudinal edge is directed to the outside of the panel relative to that edge so that when mounted, the hook-shaped bend directed to the inside of the first angle section of one panel interfits into the bend of the angle section web directed to the outside on the adjacent backing panel. The height of the web of the angle having the bend directed to the outside which is on the second angle section corresponds to the width of the ventilation space.

The plaster backing panels thus have angle sections mounted on the inner surface which serve a multiple function. Firstly, they help to stiffen the plaster backing panel in its longitudinal direction. Moreover, they provide a secure and immoveable connection between two adjacent plaster backing panels, which is achieved by engaging the one hook-shaped bend into the other hook-shaped bend. In addition, the angle sections also serve as spacers to form the ventilation space so that an outer lathing can be completely eliminated. This considerably simplifies the mounting work at a construction site. Since the plaster backing panels have a relatively high rigidity in their longitudinal direction and are connected together in an immovable position by the angle sections which engage with each other, wire mesh reinforcement can be eliminated. Furthermore, the plaster layer on the mounted panels can be relatively thinly applied which likewise reduces labor at the construction site. Since the new plaster backing panels have a relatively high rigidity, it is also feasible to apply a plaster layer at the factory and after mounting, recoat them with a highly resilient exterior paint to provide a uniform surface. A further design possiblity for the outer layer on the plaster backing panels is to coat them at the factory with mineral chips or plastic chips and mount them as finished decorative panels. The texture of such mounted plaster backing panels would then resemble a natural stone finish but would be well covered by the coarse chip surface. The joints between adjacent panels can be joined with transparent, permanently elastic putty or a tinted adhesive.

Additional features and advantages of the invention will become apparent from the ensuing description and claims taken in conjunction with the accompanying drawings.

DESCRIPTION OF PREFERRED EMBODIMENTS

Figure 1:
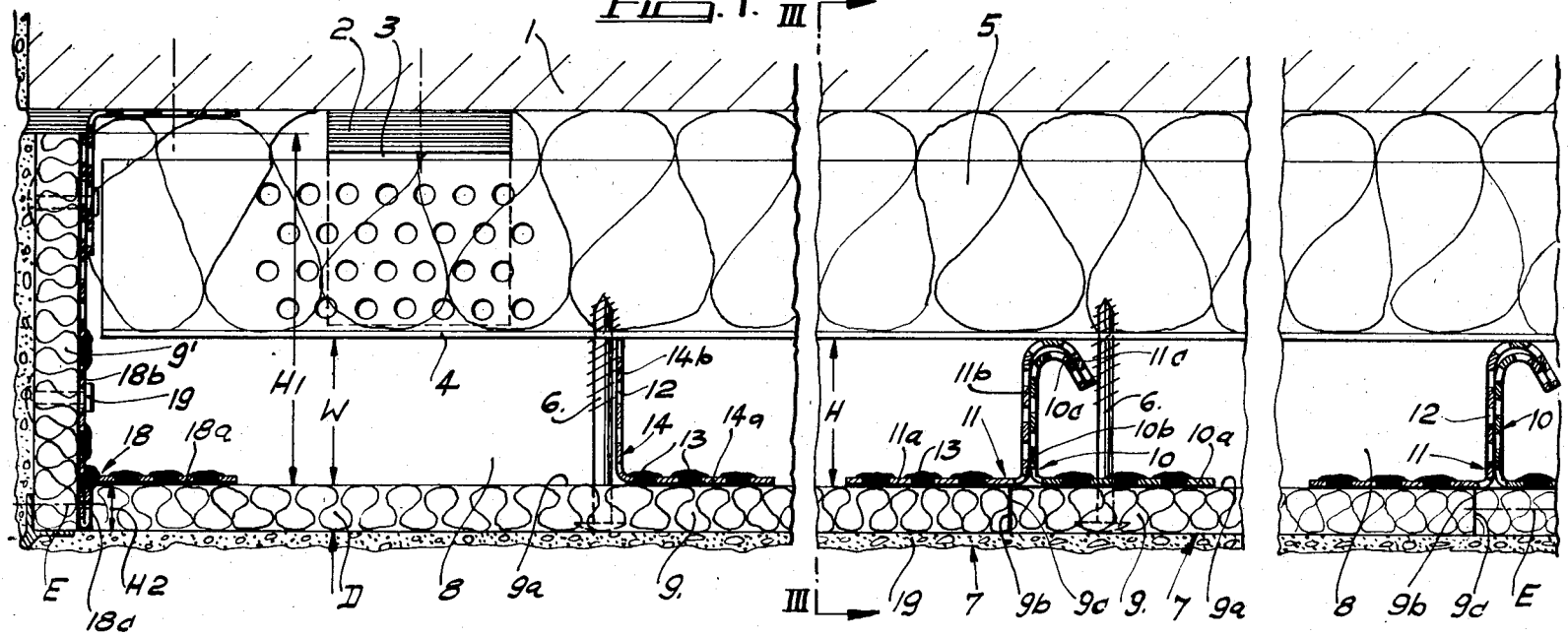
FIG. 1 is a horizontal sectional view on line I—I of FIG. 3 of a curtain wall system including plaster backing panels according to the invention.

Holding angles 3 are mounted on a vertical building wall 1 at relatively large distances from each other using neoprene separators. Horizontally running angle sections 4 are mounted on the holding angles so that their outer, vertically positioned webs 4*a* have a distance from the building wall 1 which more or less corresponds to the thickness of an insulating layer 5. Plaster backing panels in accordance with the invention can be secured directly to the horizontally running angle sections 4. The angle sections 4 are made preferably of galvanized perforated steel plate, with individual holes which can be used for the passage of holding-down screws 6. It is also feasible, instead of the angle sections 4, to use simple wood battens as framework. The sections 4 should be placed at a vertical distance of about 600 mm from one another.

Rectangular light-weight wood fiber panels 9, for example magnesite-bound light-weight wood fiber panels, are used to make the plaster backing panels 7. They may be 2000 mm long, 500 mm wide and 8–15 mm thick.

Between the plaster backing panels 7 and the insulating layer 5 there should be a ventilation space 8 with a width W, for example, of 25 mm.

Figure 2:
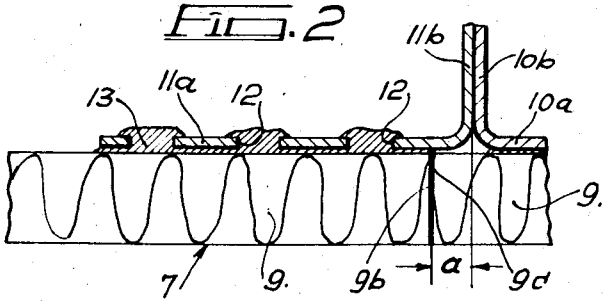
FIG. 2 is a detail view in cross-section of an adhesive bond between an angle section and a light-weight wood-fiber panel.

On the inner side 9*a* which faces the ventilation space of the light-weight panel 9, angle sections 10, 11 are affixed at the factory to its longitudinal edges 9*b*, 9*c*. At least the one web 10*a*, 11*a* of each angle section 10, 11 which lies against the inner side 9*a* of the panel is formed with an array of holes 12. These holes 12 are filled with an adhesive 13 which is thick enough on the inner side 9*a* of the light-weight panel 9 that it presses through the holes in the one web of the angle section 10*a*, 11*a* and forms rivet-head like concentrations on the side of the web 10*a*, 11*a* facing away from the light-weight panel, as can be clearly seen in FIG. 2. In this way there is not only an adhesive bond between the adhesive layer and the angle sections, but also a form-locking bond similar to a rivet joint. A suitable adhesive for this application is a two-component synthetic adhesive.

The outer webs 10*b*, 11*b* of the respective angle sections 10, 11 each have a cross section which is bent in the shape of a hook. The web 10*b* of the first angle section 10 is bent toward the center of the panel relative to the longitudinal edge 9*b*, forming a hook 10*c*. The web 11*b* of the second angle section 11 is bent toward the outside of the panel relative to the other longitudinal edge 9*c*, thus forming the hook-shaped bend 11*c*. The hook-shaped bends 10*c* and 11*c* are shaped in such a way that when assembling, the bend 10*c* directed towards the inside of the first angle section 10 of one plaster backing panel 7 fits into the bend 11*c* directed towards the outside of the second angle section 11 of an adjacent plaster backing panel.

Furthermore, the height H of the web 11*b* corresponds substantially to the width of the ventilation space 8.

In order for the plaster backing panels to be mounted with their longitudinal edges 9*b*, 9*c* running either vertically or horizontally, and in order to ensure that air can rise into the ventilation space 8 when the panels are mounted horizontally, the webs 10*b*, 11*b* of the respective angle sections 10, 11 may also each have an array of holes. Thus it is suitable to have each of the angle sections 10, 11 made out of perforated galvanized steel plate.

The second angle section 11 is affixed to the light-weight panel 9 so that its one web 11*a* extends for a predetermined distance of a few mm beyond the associated longitudinal edge 9*c*. The first bent section 10 is affixed to the light-weight panel 9 in such a way that it is spaced inwardly relative to the associated longitudinal edge 9*b* by the same amount a. This has the advantage that after proper mounting, the longitudinal edge 9*b* of one plaster backing panel can rest upon the angle web 11*a*, and inversely, which further improves the connection between two adjacent panels.

A further advantage is that each of the hook-shaped bends 10*c*, 11*c* extends towards the panel surface E-E in a V-shape. This makes mounting of the panels easier and ensures a good fit between the bends 10*c*, 11*c* free from play as they engage in each other.

Furthermore, it is also useful to provide at least one further angle section 14 between the angle sections 10, 11 located on the longitudinal edges 9*b*, 9*c*, which extends parallel to the longitudinal edges 9*b*, 9*c*. The web 14*a* of angle section 14 which is affixed to the inner side 9*a* of the light-weight panel 9 is also formed with an array of holes filled with adhesive. For the reason stated above, the other angle web 14*b* also has holes 12. The second web 14*b* has a height H which again corresponds to the predetermined width W of the ventilation space 8.

Figure 5:
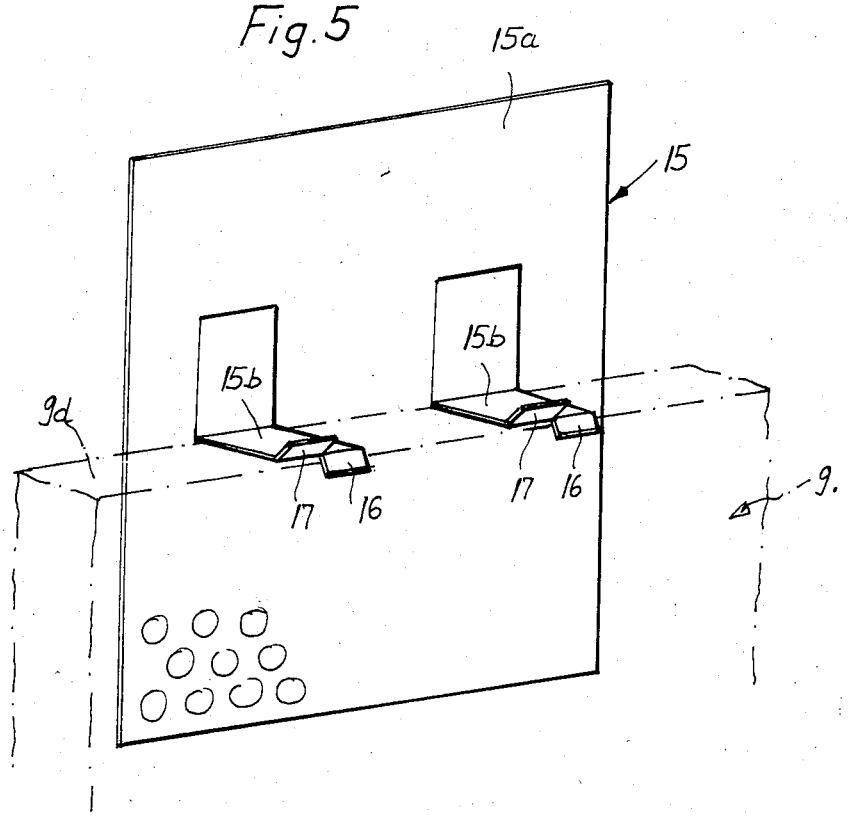
FIG. 5 is a schematic diagram of a butt plate.

On the other side 9*a* of one transverse edge 9*d* of each light-weight panel is attached a butt plate 15 having a plurality of holes. A portion 15*a* of the butt plate, which is shown in more detail in FIG. 5, extends over the transverse edge 9*d* in an upwards direction. At least one further portion 15*b* is bent down at a right angle to the outside of the light-weight panel. On the outside this protion 15*b* has a flap 16 which is inclined towards the center of the panel and a flap 17 which is inclined away from the transverse edge of the panel. The flap 16 forms a holding lug which provides additional anchoring of the butt plate 15 to the light-weight panel 9. The flap 17 forms a holding lug which secures an adjacent light-weight panel.

Figure 3:
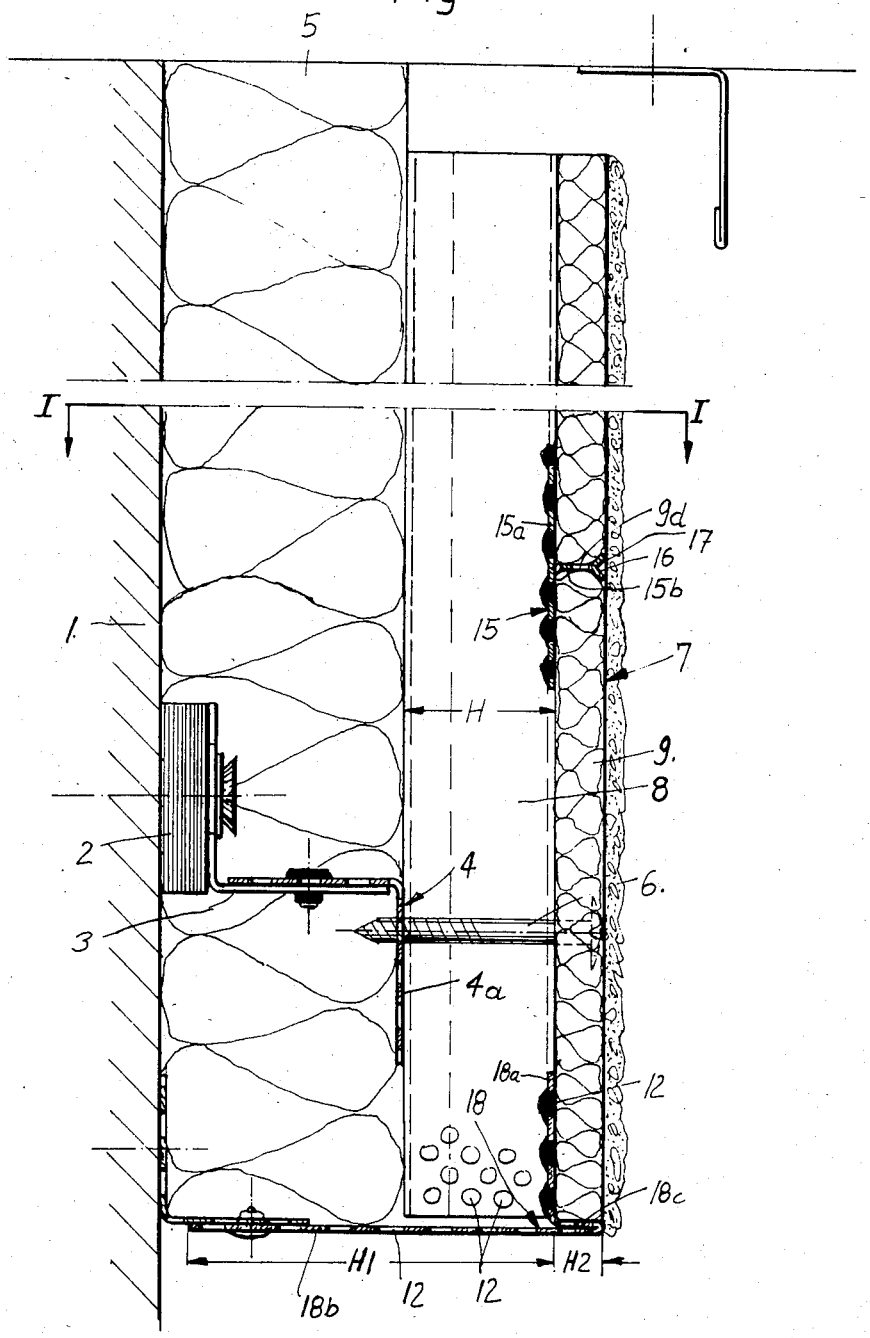
FIG. 3 is a vertical sectional view on line III—III of FIG. 1.

In order to form a corner, as shown in FIG. 1 to the left, or a foundation closure, as shown in the bottom of FIG. 3, an angle member 18 is affixed to the appropriate edge of the light-weight panel 9, both webs 18*a*, 18*b* of which are also formed with a series of holes. Web 18*a* is fastened with adhesive as previously described to the inside 9*a* of the light-weight panel 9. The second web 18*b*, which extends prependicularly to the inside 9*a*, has a height H1 which is larger than the predetermined width W of the ventilation space 8.

The second web 18*b* of the angle member 18, where it connects to the first web 18*a*, has a folded extension 18*c*, directed to the outer side of the light-weight panel 9, for a distance H2 roughly equeal to the thickness D of the light-weight panel 9. The angle member is bent back 180 degrees and perpendicularly to the web 18*b* to form web 18*a*. When using the angle member as a foundation closure, the bend 18*c* becomes a protective strip for the bottom transverse edge of the light-weight panel. In this application, the holes in the web 18*b* allow the air to circulate vertically, while keeping rodents such as mice, from getting into the ventilation space. When using the angle member 18 to make a corner, a light-weight panel 9' is affixed thereto. while the adhesive layer is setting, light-weight panel 9' can be held in place, for example, by rivets 19.

Figure 4:
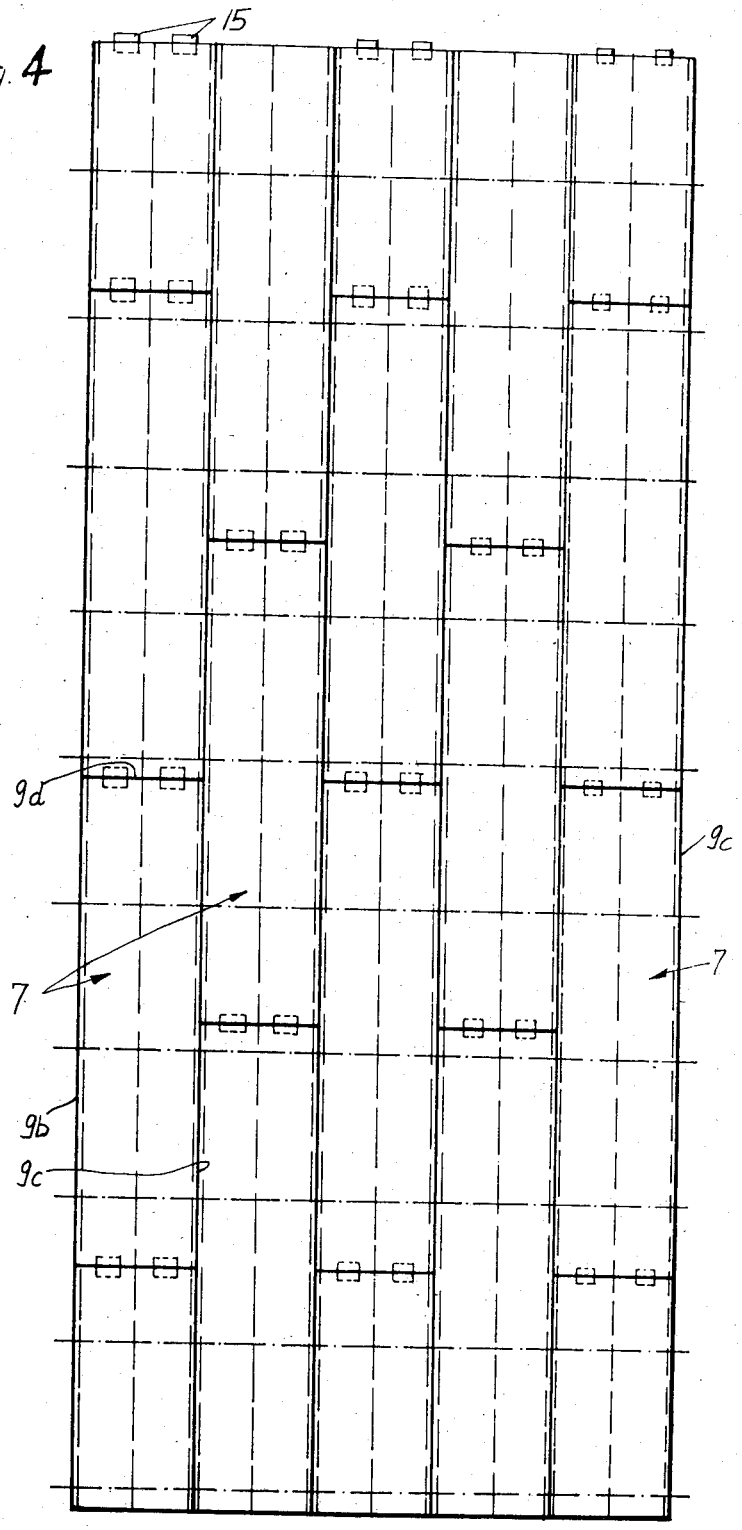
FIG. 4 shows a laying pattern for the plaster backing panels.

FIG. 4 shows a laying pattern for the panels with the longitudinal edges 9*b*, 9*c* of the panels in a vertical direction. Mounting is begun on the lower left corner. A first row of plaster backing panels 7 are mounted vertically one on top of the other. Screws 6 attach the plaster backing panels 7 to the framework; the panels being simple to position through the holes in the perforated plate and the threads are self cut in the holes. The webs 11*b* and 14*b* of the angle sections 11, 14 touch the L section 4 and determine the unobstructed width W of the ventilation space 8. They also serve as added holders for the insulating layer 5. An ample amount of adhesive is applied during mounting on the inside of the panel to be mounted which lies above, in the area of the butt plate 15 and also on the extending protion 15*a* of the butt plate 15. Once set, this adhesive forms a secure bond between the extending portion 15*a* and the plaster backing panel. Until this adhesive hardens the plaster backing panel is aligned and held by the upwardly extending holding lug 17. A bonding mortar can also be applied between the transverse edges of adjacent plaster backing panels.

Once a vertical row of plaster backing panels has been mounted in this way, the next horizontally extending row can be started. During mounting, the hook-shaped bend 10*c* of the angle section 10 of a panel being mounted fits into the hook-shaped bend 11*c* of the angle section 11 of an already mounted panel. After screwing in the hold-down screws 6, the two adjacent panels are held immobile against each other. Here again, a layer of bonding mortar can be applied between the abutting longitudinal edges 9*b* and 9*c*.

After all plaster backing panels are mounted, the plastering can begin. To this end, it is useful to apply a fiberglass mesh together with an adhesive intermediary. A thin synthetic-resin coating 19 or a mineral plaster can be applied to this prime coat without a wire net reinforcement being necessary. Mention has already been made of the possibility of applying the plaster layer at the factory.

While only two preferred embodiment of the invention has been described herein in detail, the invention is not limited thereby and modifications can be made within the scope of the attached claims.

Figure 6:
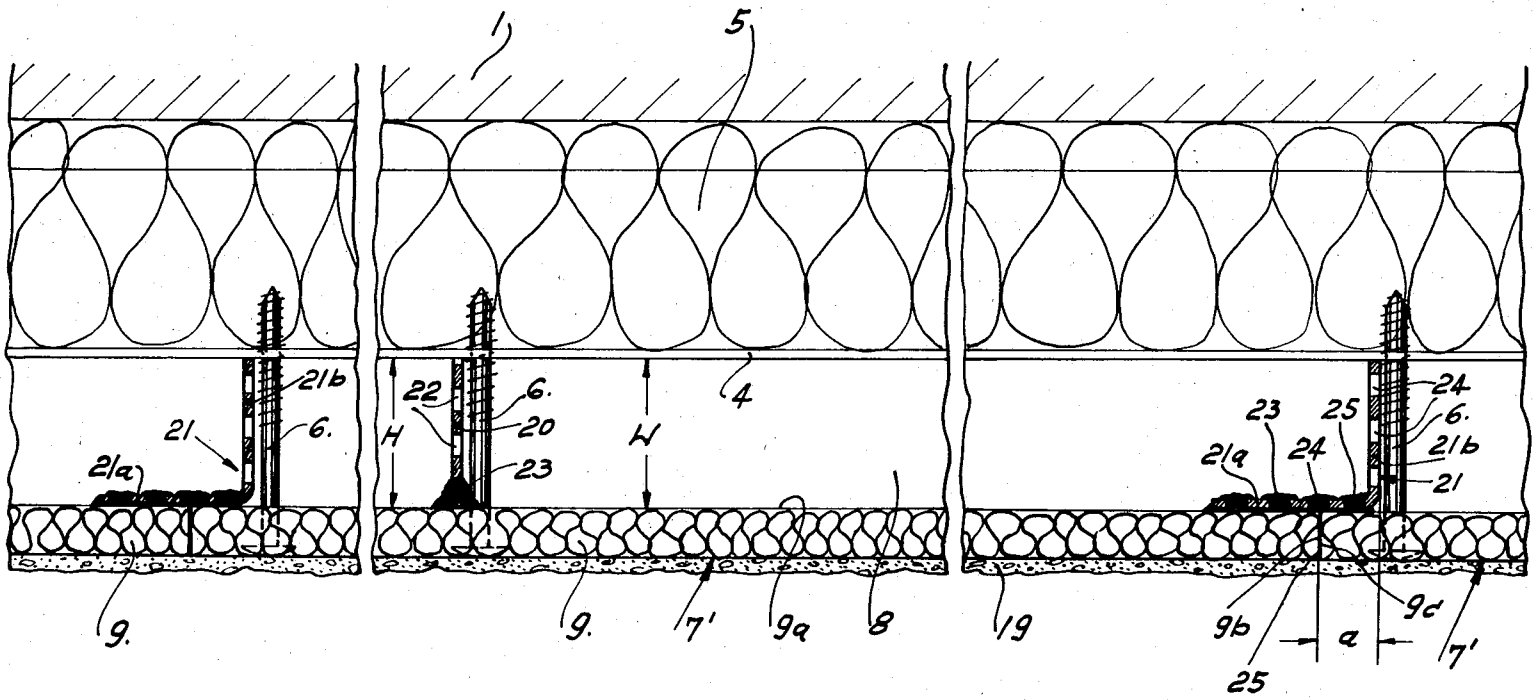
FIG. 6 is a horizontal sectional view of a second embodiment of the invention

FIG. 6 describes a second especially advantageous embodiment of the invention. In so far as the parts of this embodiment have the same construction and the same function as the parts in the embodiment described by FIGS. 1–5, the same reference numbers are used. Similarly, the above description pertains therefore to these parts. Rectangular light-weight wood fiber panels consisting of wood fiber and mineral binding agents are also used to make the plaster backing panels 7'. On the rear face 9*a* of the panel 9 facing toward the ventilation space 8, at least two metal webs 20, 21*b* extending parallel to the longitudinal edges 9*c*, 9*b* and vertically to the rear face 9*a* of the panel 9 have been affixed at the factory by bonding. The web 20 has a number of holes 22. The web 20 can, for example, consist of perforated metal plate, especially of an aluminum plate. Galvanized steel plate can also be used instead of aluminum. The height H of the web 20 corresponds to the width W of the ventilation space 8. The web 20 is affixed by adhesive 23, preferably a hot-melt adhesive, to the rear face 9*a*. A two component synthetic adhesive can be used if necessary instead of a fusible adhesive. The adhesive 23 is applied in such an ample manner that it penetrates the holes 22 of the web 20 lying next to the rear face 9*a*, so that a mechanical anchoring such as that of a rivet head is produced, The web 21*b* is an integral part of an angle section 21 of aluminum or galvanized plate. The web 21*a* of the angle section 21 lying on the rear face 9*a* has a number of holes 24. These holes 24 are penetrated by adhesive 23, which has been applied so thickly to the rear face 9*a* that it penetrates the holes 24 and forms concentrations such as those of rivet heads on the other side of the side 21*a* away from the panel 9. The web 21*b* extending vertically to the rear face 9*a* forms a web, whose height H corresponds to the width W of the ventilation space 8. The web 21*b* also has a number of holes 24. The angle section 21 can either be of a perforated metal plate or of an extruded aluminum section into which the holes 24 have been subsequently punched.

The angle section 21 is so arranged on a longitudinal edge 9*c* of the panel 9 that one web 21*a* projects for a predetermined distance "a" beyond the longitudinal edge 9*c* of the panel 9. The projecting part of this web 21*a* forms a resting surface for the adjacent panel 9. The distance "a" is dimensioned large enough so that holes 24 are present in the area of the resting surface.

The installation of the plaster backing panels 7' is performed in the same manner as the previously described mounting of the plaster backing panels 7 in FIGS. 1–5 of the described embodiment. First a vertical column of plaster backing panels 7' is installed, then the next horizontally adjacent row can be placed. In this process, an ample amount of adhesive 25 is first applied to the longitudinal edge 9*c* and also over the part of the web 21*a* projecting beyond the longitudinal edge 9*c*, preferably a two-component synthetic adhesive being used. The projecting part of the web 21*a* serves as resting surface fot the next, adjacent panel to be installed. Due to the resting of the adjacent panel on the projecting part of the web 21*a*, the adjacent panel ist exactly aligned relative to the panel already installed, so that the rear faces 9*a* of both panels and thus their outer sides also lie exactly in one plane. Due to the presence of the adhesive 25 between th longitudinal edges 9*b* and 9*c*, and also due to the presence of the adhesive between the projecting part of the web 21*a* and the rear face 9*a* of the adjacent panel 9, the adjacent panels 9 are securely connected to each other; a form-locking bond (positive-Locking bond) is produced between the projecting part of the web 21*a* and the adhesive 25.

After all plaster backing panels are mounted, a thin plaster layer 19 can be applied as described above.

If necessary, the web 20 can also be an integral part of an angles section which is then connected in a similar way with one side to the rear face 9*a* of the panel 9, as is the angle section 14 of the first embodiment or the angle section 21.

In the embodiment of the invention described in FIG. 6, the webs 20 and the angle sections 21 also have a multiple function. They help to provide rigidity of the plaster backing panel in its longitudinal direction. In addition, they serve as spacers for the formation of the ventilation space. If the angle section provided at one longitudinal edge of the panelsprojects beyond the longitudinal edge with one side, this side forms in addition a resting surface for the adjacent panel, and, in connection with the adhesive applied during installation, also an additional adhesive surface. It has been determined that the adhesive applied during installation between the longitudinal edges of the adjacent panels provides such a good connection between the longitudinal edges adjoining each other of both panels that no crack formation occurs in the area of the connection point of both these panels.

I claim:

1. A plaster backing panel structure for a ventilated curtain wall system comprising a rectangular light-weight wood fiber panel for mounting on a framework attached to a vertical building wall so as to leave a ventilation space of a predetermined width behind the panel, wherein the panel includes respective angle sections affixed to a rear face of the panel adjacent respective longitudinal edges thereof, the angle sections having respective first webs engaging the rear face of the panel and formed with an array of holes filled with adhesive and respective second webs extending rearwardly from the rear face of the panel, the second webs each being bent to form a hook in cross section, the second web of a first of the angle sections being bent toward the center of the panel and the second web of the second angle section being bent away from the center of the panel, the respective second webs being of complimentary shape so that when mounting adjacent panels, the second web of a first angle section on one panel interfits with the second web of the second angle section on the adjacent panel to form a male and female connection.

2. The invention of claim 1 wherein the female interfitting web has a height substantially corresponding to the width of the ventilation space.

3. The invention of claim 1 wherein the adhesive provides rivet head-like projections from the respective holes in the first webs of the angle sections.

4. The invention of claim 1 wherein the adhesive is one of a two-component symthetic adhesive and a hot-melt adhesive.

5. The invention of claim 1 wherein the second web of each angle section also has an array of holes.

6. The invention of claim 1 wherein one of the angle sections projects beyond the respective edge of the panel and the other angle sections is spaced correspondingly inwardly of the respective edge of the panel.

7. The invention of claim 1 wherein the respective angle sections are formed from galvanized perforated steel plate.

8. The invention of claim 1 including a further angle section on the rear face of the panel between and parallel to the first and second angle sections, the further angle section having a first web with an array of holes containing adhesive securing same to the rear face of the panel and a second web extending rearwardly from the rear face of the panel and having a height corresponding substantially to the width of the ventilation space.

9. The invention of claim 1 including a butt plate affixed to a transverse edge of the panel on the inner face thereof, the butt plate having a portion extending beyond the transverse edge.

10. The invention of claim 9 wherein the butt plate includes at least one tab engaging the transverse edge of the panel, the tab including holding lugs inclined respectively toward and away from the center of the panel.

11. The invention of claim 1 including an angle member affixed to one edge of the panel to provide one of a corner closure and foundation closure, the respective webs of the angle member each having an array holes and one web of the angle member extending perpendicular to the inner face of the panel and having a height greater than the width of the ventilation space.

12. The invention of claim 11 wherein said first web of the angle member has an extension which is doubled back on itself and bent at right angles to form a second web of the angle member secured to the rear face of the panel.

13. The invention of claim 12 wherein the extension has a width substantially corresponding to the width of the panel.

14. A plaster backing panel structure for a ventilated curtain wall system comprising a rectangular lightweight wood fiber panel for mounting on a framework attached to a vertical building wall so as to leave a ventilation space of a predetermined width behind the panel, wherein the panel includes at least two metal webs bonded to a rear face of the panel parallel to the longitudinal edges thereof, said webs being arranged vertically to the rear face of the panel and formed with an array of holes, of which those holes adjacent to the rear face are filled with adhesive, the webs having a height substantially corresponding to the width of the ventilation space, and the panels on installation being connected to each other by adhesive at least at the adjacent longitudinal edges, wherein said web is an integral part of an angle section whose one web is bonded to the rear face of the panel, the holes of the web being penetrated by adhesive, and whose other web forms said web, and wherein an angle section only being arranged at one longitudinal edge of the panel and projecting with one web by a predetermined distance beyond the selected longitudinal edge of the panel, the projecting part of the limb serving on installation as resting surface for an adjacent panel.

15. The invention of claim 14 wherein said distance being so dimensioned that holes are present in the area of the resting surface.

* * * * *